US006106062A

United States Patent [19]

Ambrose, Jr. et al.

[11] Patent Number: 6,106,062

[45] Date of Patent: Aug. 22, 2000

[54] GLIDER/ROCKER LIFT CHAIR

[75] Inventors: Robert C. Ambrose, Jr., Harveys Lake; Kenneth J. Casey, Archibald, both of Pa.

[73] Assignees: Kenneth Casey, Plymouth; Kenneth Kemmerer, Laurel Lakes, both of Pa.

[21] Appl. No.: 09/307,782

[22] Filed: May 10, 1999

[51] Int. Cl.[7] ..... A47C 1/02

[52] U.S. Cl. ..... 297/281; 297/270.1; 297/DIG. 10; 297/273

[58] Field of Search ..... 297/258.1, 259.3, 297/270.1, 270.2, 270.3, 273, 281, 282, DIG. 10

[56] References Cited

U.S. PATENT DOCUMENTS 4,083,599 4/1978 Gaffney .
4,707,026 11/1987 Johansson ..... 297/281
5,024,486 6/1991 Auel .
5,344,214 9/1994 Trent ..... 297/270.2
5,641,201 6/1997 Casey et al. .
5,651,580 7/1997 LaPointe et al. ..... 297/DIG. 10 X
5,704,686 1/1998 May ..... 297/281
5,795,021 8/1998 Rogers ..... 297/281
5,895,093 4/1999 Casey et al. .

*Primary Examiner*—Peter R. Brown
*Attorney, Agent, or Firm*—David A. Tamburro

[57] ABSTRACT

A chair comprises a base, a seat support frame which is longitudinally movable back and forth with respect to said base, and a seat. A lift mechanism mounts the seat on the frame and is capable of lifting said seat from a lowered seating position to a raised position to assist an occupant in exiting from the seat. Locking means is actuatable as the seat is raised to lock the frame against movement with respect to said base. The locking means is released as the seat is lowered to its seating position to free the frame for movement with respect to said base.

10 Claims, 3 Drawing Sheets

GLIDER/ROCKER LIFT CHAIR

BACKGROUND OF THE INVENTION

This invention relates generally to chairs and, more particularly, to a novel glider/rocker chair in which the seat may be raised vertically and forwardly to assist the occupant in standing up from a seated position.

Glider/rocker chairs have been popular for many years and provide a relaxing, comforting motion which is especially enjoyed by people such as elderly persons, pregnant women, and mothers of newborns. However, at times those persons find it difficult to stand up from the seat, especially with the seat movable in the gliding/rocking motion.

SUMMARY OF THE INVENTION

Accordingly, the primary object of this invention is to provide a novel chair in which the seat is longitudinally movable in a gliding and/or rocking motion with respect to a support base. The seat is also automatically liftable with respect to the base to raise the occupant to a standing position and the gliding rocking movement is prevented when the seat is in a lifted, raised position.

Another object of the invention is to provide the above novel chair which includes a unique locking mechanism which locks the frame of the seat to the support base to prevent the gliding/rocking movement when the seat is in the raised position, the locking mechanism being automatically released when the seat is lowered to its normal seating position to again permit gliding/rocking movement of the seat.

The novel chair of the intention enables its users to continue to enjoy the relaxing soothing motion of a standard glider/rocker. In addition, it advantageously safely raises those users to a standing position to assist them in getting into and out of the chair.

Other objects and advantages of the invention will become apparent from reading the following detailed description of the invention in which reference is made to the accompanying drawings.

DETAILED DESCRIPTION OF THE INVENTION

Figure 1:
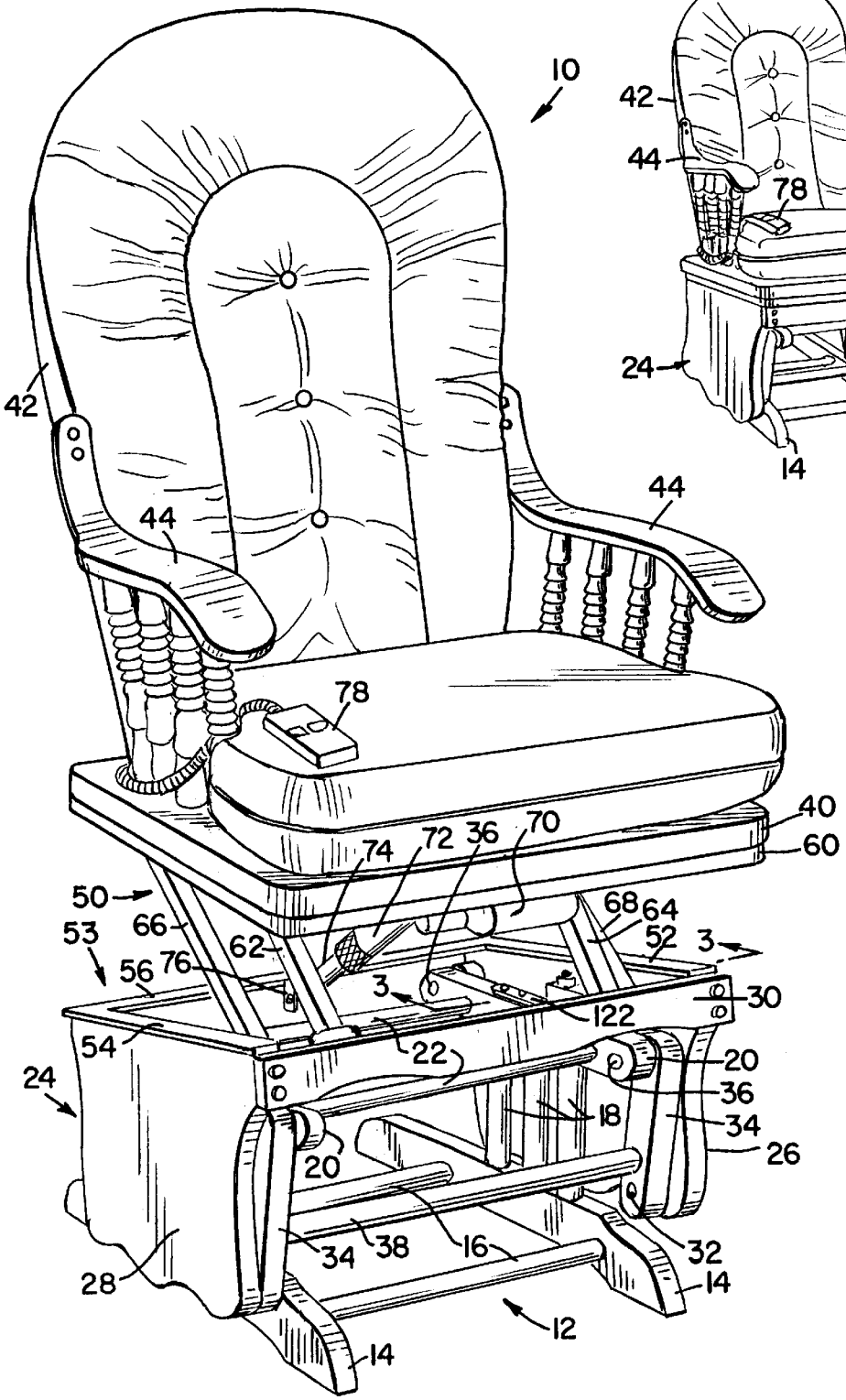
FIG. 1 is a generally perspective view of the novel chair of the invention illustrating the seat in a raised position.

The novel chair 10 of the invention includes a wooden support base 12 having a pair of floor engaging longitudinal foot members 14 connected by transverse rods 16. A plurality of vertical posts 18 (or a wooden plate) are fixed to each member 14 and longitudinal bars 20 are fixed to the top of posts 18 in overlying relationship with members 14. A plurality of transverse stabilizing rods 22 extend between bars 20. All these elements are fixed together and form part of the stationary support base 12.

A seat support frame 24 includes vertical side panels 26 and 28 connected at their tops by a front brace 30. Each panel has its bottom comers pivotally connected at 32 to the lower end of pivot arms 34 on the outside faces thereof, the upper ends of which are pivotally connected at 36 on their inside faces to the ends of bars 20. A stabilizing rod 38 extends between each set of arms 34 at the front and rear of frame 24. As a result, a lateral space 29 equal to at least the thickness of arms 34 is present between the outside faces of bars 20 and the inside faces of panels 26 and 28.

As described thus far, frame 24 and base 12 are of standard construction used in prior glider rockers and permit back and forth glider movement of frame 24 (and any seat supported thereon) with respect to base 12. For example, glider chairs sold by Brooks Company utilized this type of mechanism.

Chair 10 includes a flat bottomed seat 40 having the usual back 42 and side arms 44 fastened thereto. A lift mechanism 50 is mounted between frame 24 and seat 40 and enables seat 40 to be raised vertically and tilted forwardly to assist its occupant to stand up from the seat. Mechanism 50 is similar to the lift mechanism illustrated in U.S. Pat. No. 5,641,201 and incorporated in an EnhanSit® lift frame sold by American Dream International Corporation of Luzerne, Pa. Mechanism 50 includes an open angle-iron frame 53 having side members 52 and 54 fastened on top of panels 26 and 28 and connected together by rear member 56. Mechanism 50 also has an angle-iron frame 60 extending around the bottom periphery of seat 40. Frame 60 is connected to frame 53 by a pair of short pivoting front lever arms 62 and 64 and longer pivoting rear lever arms 66 and 68.

A self contained compact reversible electric motor unit 70 is connected to frame 60 underneath the front portion of seat 40 and includes a worm screw 72 and a lift tube 74 which threads in and out on screw 72 as the motor and screw are rotated in one direction or the other. The outer end of tube 74 is pivotally connected to bracket 76 which is welded to rear member 56. A hand operated switch 78 having up and down buttons controls the power to and direction of rotation of the motor unit 70.

Figure 2:
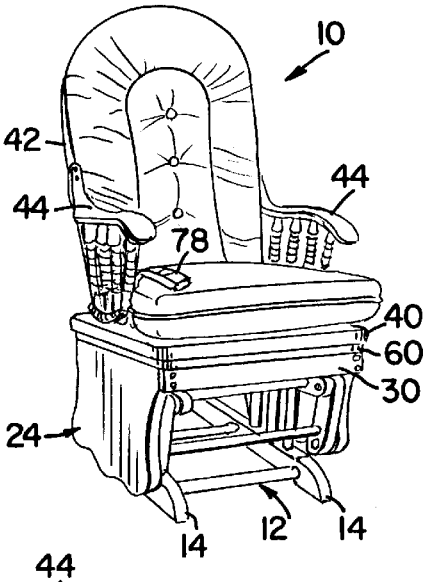
FIG. 2 is a view similar to FIG. 1 illustrating the seat in a normal lowered seating position.
Figure 5:
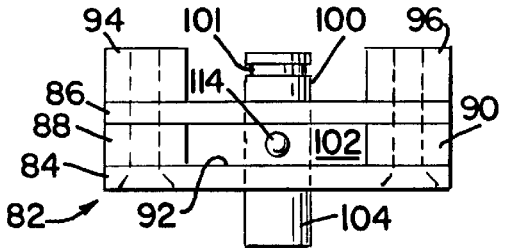
FIG. 5 is a top plan view taken along line 5—5 of FIG. 4.

In the down, seated position of FIG. 2, frame 60 sits on frame 53 and motor unit 70, tube 64, and lever arms 62, 64, 66, and 68 are received in the space underneath seat 40. To lift frame 60 and seat 40 with respect to frame 53 and frame 24, the up button on switch 78 is pressed to rotate motor unit 70 in a direction such that tube 74 threads outwardly on screw 72, causing seat 40 to be raised upwardly and tilted forwardly as shown in FIG. 1, due to the different lengths of arms 62 and 64 and arms 66 and 68.

For safety purposes, as seat 40 is lifted from the seating position of FIG. 2 to a raised position of FIG. 1, it is desirable that the seat support frame 24 be locked against any gliding/rocking movement with respect to base 12. Otherwise, any rocking or unsteady movement of the seat in a raised position may cause its occupant to fall and injure himself.

Figure 3:
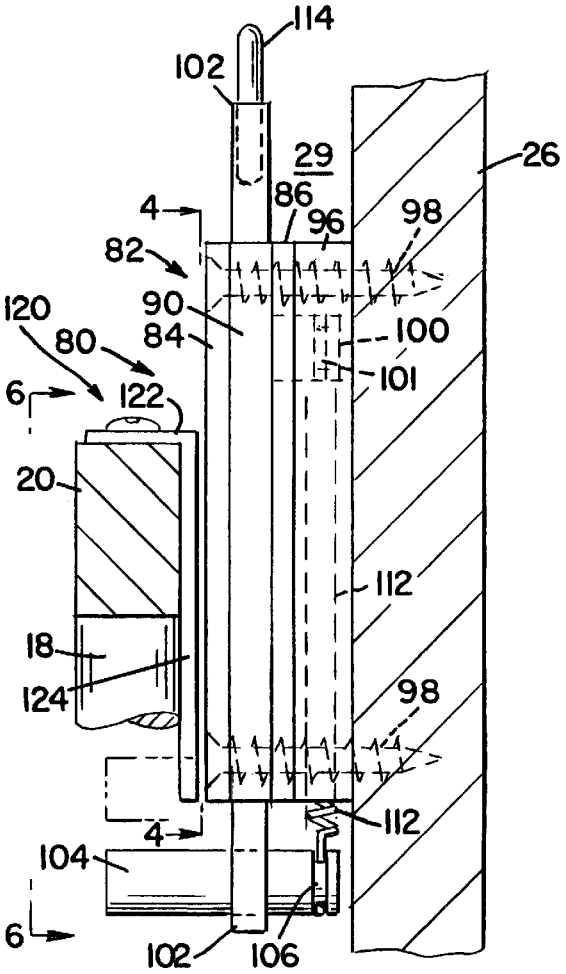
FIG. 3 is a fragmentary sectional elevational view taken along line 3—3 of FIG. 1 generally illustrating one embodiment of the lock mechanism by which gliding motion of the seat is prevented when the seat is in the raised position.
Figure 6:
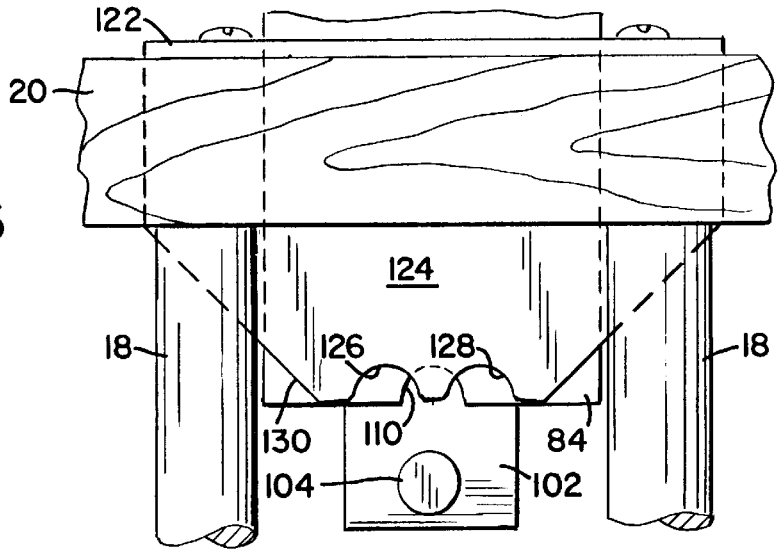
FIG. 6 is a fragmentary view taken along line 6—6 of FIG. 3.

To avoid this problem a lock mechanism 80 (FIGS. 3–6) is mounted in the space 29 on each side of the chair, with one mechanism 80 acting between a bar 20 and left side panel 26 and the other acting between a bar 20 and right side panel 28. The mechanism 80 mounted on the left side of the chair (as shown in FIGS. 3 and 6) includes a plunger assembly 82, fixed vertically against the inside face of movable panel 26. Assembly 82 includes an outer lock plate 84, an inner lock plate 86, plates 88 and 90 which space plates 84 and 86 to provide a space 92 therebetween, mounting spacers 94 and 96 engaging the inside face of panel 26 and a series of mounting screws 98 fastening assembly 82 to panel 26. As inwardly projecting stub 100 is fixed to the upper end of plate 86, the stub having a circular groove 101. A rectangular plunger bar 102 is vertically slidably mounted within space 92 and its upper and lower ends project beyond plates 84 and 86. A lock pin 104 extends transversely through the lower end of plunger 102 and has a circular groove 106 which generally aligns with groove 101. Plates 84 and 86 have locking grooves 110 on their bottom ends, and an upwardly biasing spring 112 connects between grooves 101 and 106 to normally pull plunger 102 upwardly and seat pin 104 in grooves 10. A rounded contact pin 114 is fixed on the upper end of plunger 102 for operating engagement by a lever arm 66 or 68 when seat 40 is in its seating position as will later be described.

Mechanism 80 also includes a locking latch device 120 having a horizontal flange 122 fixed via screws to the top face of stationary bar 20 and a vertical plate 124 extending down alongside the outside face of bar 20 in facing opposition to plate 84. The bottom end face of plate 124 has a pair of spaced circular locking grooves 126 and 128 formed therein to selectively receive lock pin 104 when the seat is in the raised position. The corners 130 and 132 are chamfered towards grooves 126 and 128 to guide pin 104 toward the grooves and to prevent the pin from hanging up on the plate.

Figure 4:
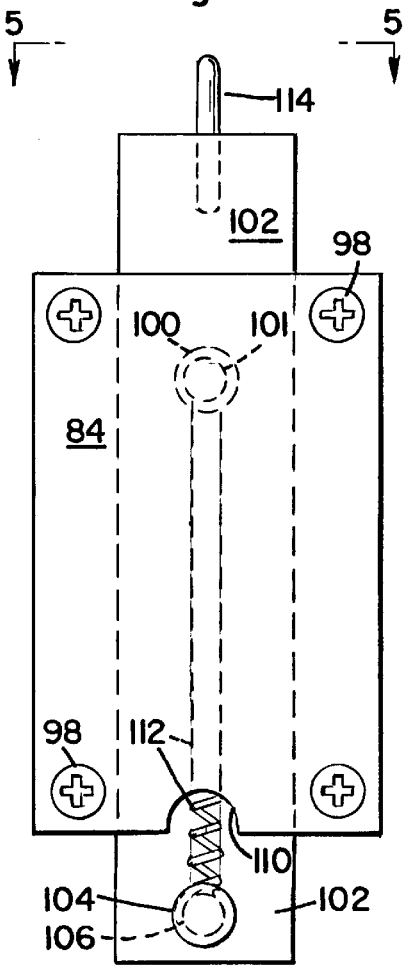
FIG. 4 is a fragmentary view taken along line 4—4 of FIG. 3.

In operation, when seat 40 is in its lowered seating position of FIG. 2, the folded lever arms 66 and 68 of lift mechanism 50 engage against contact pins 114 of lock mechanisms 80 to push plungers 102 downwardly against the bias of springs 112 to their release positions of FIGS. 3, 4 and 6, removing lock pin 104 from engagement in grooves 110 and groove 126 or 128. With mechanisms 80 in this release position, side panels 26 and 28 are unlocked from stationary bars 20 and seat support frame 24 is free to glide and rock back and forth with respect to base 12 in normal fashion.

When it is desired to raise seat 40 from frame 24, the occupant will stop rocking and will press the up button on switch 78 to energize motor unit 70 to extend tube 74 from rod 72, thereby causing arms 62, 64, 66 and 68 to be raised as shown in FIG. 1. As this occurs within about the first inch of travel of seat 40, arms 66 and 68 disengage from contact pins 114 and plungers 102 are pulled upwardly by springs 112, seating lock pin 104 in grooves 110. Depending on the position of panels 26 and 28 when the occupant stopped rocking, lock pin 104 will also seat within groove 126 or groove 128 depending upon which one aligns with grooves 110. To ensure proper seating of pin 104 in grooves 110 and in groove 126 or groove 128 before continuing to lift the seat, the consumer can be advised to shift his weight slightly forward and rearward to confirm that gliding or rocking motion is prohibited. Once this is done, the seat can be safely raised and tilted forwardly to an elevation at which the occupant can comfortably exit the seat.

As seat 40 is again lowered towards frame 24 arms 62, 64, 66 and 68 are folded downwardly and when frame 60 is within about one inch travel of frame 53, arms 66 and 68 again engage contact pins 114 to begin pushing plungers 102 downwardly to disengage lock pins 104 from grooves 110 and groove 126 or groove 128 and position them as shown in FIGS. 3, 4, and 6 with frame 60 engaging frame 53 in the fully seating position of FIG. 2. Plates 84, 86 and 124 are no longer locked together, and seat 40 and frame 24 may be moved back and forth with respect to base 12.

Figure 8:
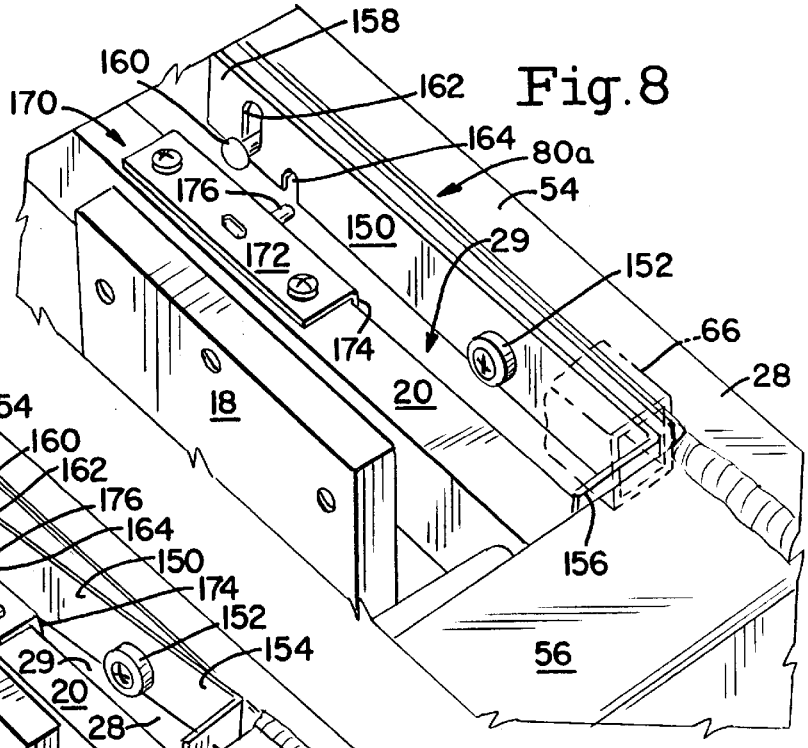
FIG. 8 is a view similar to FIG. 7 showing the locked mechanism in an unlocked position when the seat is in a lowered seating position.
Figure 7:
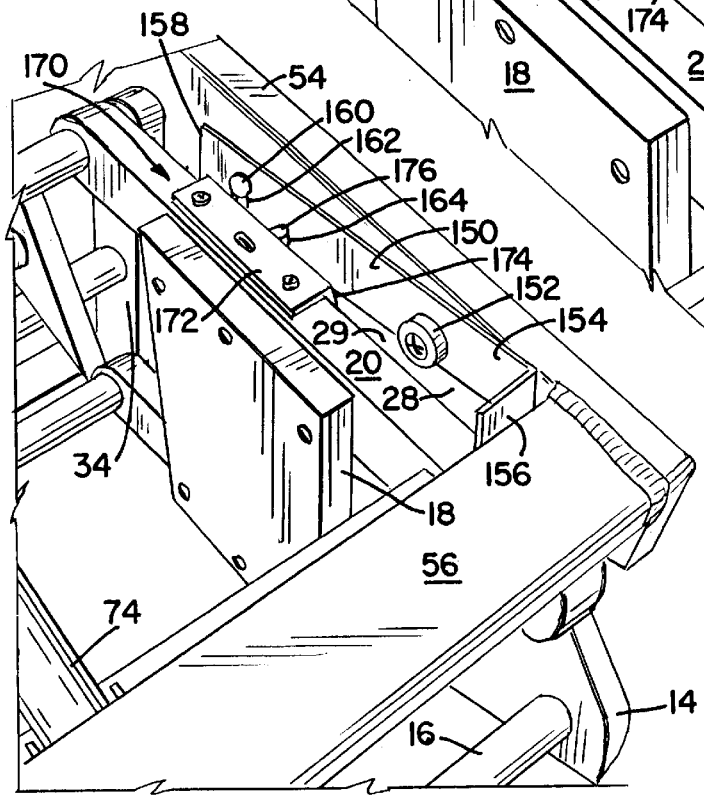
FIG. 7 is a fragmentary plan perspective view of another preferred embodiment of the lock mechanism shown in a locked position, when the seat is raised.

A simplified preferred embodiment of the lock mechanism **80*a* mounted on the right side of chair 10 is illustrated in FIGS. 7 and 8. Mechanism 80*a* includes a latch arm 150 formed from a flat bar and pivotally mounted within space 29 on pivot pin 152 which is fixed to frame member 54 and panel 28. The rearward end 154 is bent inwardly to form a tab 156 extending across space 29. The length of the front portion 158 of arm 150 extending forwardly from pivot pin 152 is longer than the rear end 154 and a guide pin 160 fixed to panel 28 rides in a slot 162 in front portion 158 and maintaining alignment of arm 150 as it pivots up and down about pin 152. An open latch slot 164 is cut into the bottom face of front portion 158**.

Mechanism **80*a* also includes a latch plate 170 having a horizontal flange 172 fastened to the top face of member 20 and a vertical flange 174 extending down the outside face of member 80, opposing front portion 158 of latch arm 150. A latch pin 176 is fixed to flange 174 and projects outwardly therefrom into operative alignment with latch slot 174**.

Because front portion 158 is longer than rear end 154, the front portion will naturally pivot downwardly under forces of gravity about pin 152 and the rear end will pivot upwardly, placing tab 156 above frame member 56. Latch pin 176 engages within slot 164 to prevent gliding movement between panel 28 and member 20 when the seat is in a raised position, as shown in FIG. 7.

As in the embodiment of FIGS. 3–6, when the seat is lowered to its seating position, the lever arms 66 and 68 will engage the top edge of tabs 156, pivoting rear end 154 downwardly and front portion 158 upwardly, disengaging slot 164 from pin 176 to permit relative movement between panel 28 and member 20 and gliding movement of the seat. The unlatched position of arm 150 after being activated by arm 66 is shown in FIG. 8.

The foregoing relates to preferred exemplary embodiments of the invention, it being understood that other variants and embodiments thereof are possible within the spirit and scope of the invention, the latter being defined by the appended claims.

What is claimed is:

1. A chair comprising a base, a seat support frame, means connecting said support frame to said base and permitting longitudinal movement of said frame with respect to said base, a seat, a lift mechanism mounting said seat on said frame and capable of lifting said seat from a lowered seating position to a raised position to assist an occupant in exiting from the seat, and locking means actuatable as said seat is raised to lock said frame against said movement with respect to said base, said locking means being released as said seat is lowered to its seating position to free said frame for said movement with respect to said base.

2. A chair according to claim 1, wherein said longitudinal movement is a gliding and/or rocking movement.

3. A chair according to claim 2, said base including a pair of laterally spaced, longitudinally extending members, said seat support frame including a pair of laterally spaced side panels each located adjacent one of said members, said connecting means connecting said side panels from said members and permitting longitudinal movement of said side panels with respect to said members, said locking means being associated with at least one of said side panels and its adjacent members and including a lock plate on one of said side panels or its adjacent member and a latch plate on the other of said side panel or its adjacent member, and a locking plunger actuatable in response to the raising of said seat to lock said lock plate and latch plate against longitudinal movement when said seat is in a raised position and actuatable in response to the lowering of said seat to unlock said lock plate and said latch plate to permit said longitudinal movement when said seat is in a lowered seating position.

4. A chair according to claim 3, said lift mechanism including pivotal lever arms supporting said seat from said side panels, one of said lever arms actuating said plunger as it is raised and lowered with said seat.

5. A chair according to claim 2, said base including a pair of laterally spaced, longitudinally extending members, said seat support frame including a pair of laterally spaced side panels each located adjacent one of said members, said connecting means connecting said side panels from said members and permitting longitudinal movement of said side panels with respect to said members, said locking means being associated with at least one of said side panels and its adjacent member and including a pivotal locking arm on one of said side panels or its adjacent member and a latch plate on the other of said side panel or its adjacent member, said pivotal locking arm and said latch plate having cooperating locking means, said pivotal arm being actuatable in response to the raising of said seat to lock said locking means when said seat is in a raised position and actuatable in response to the lowering of said seat to unlock said locking means when the seat is in a lowered seating position.

6. A chair according to claim 5, said lift mechanism including pivotal lever arms supporting said seat from said side panels, one of said lever arms actuating said pivotal locking arm as said lever arm is raised and lowered with said seat.

7. A chair comprising base means, seat means, means connecting said seat means to said base means and permitting longitudinal movement of said seat means with respect to said base means, a lift mechanism capable of lifting said seat means from a lowered seating position to a raised position to assist an occupant in exiting from the seat means, and locking means actuatable as said seat means is raised to lock said seat means against said longitudinal movement with respect to said base means, said locking means being released as said seat means is lowered to its seating position to free said seat means for said movement with respect to said base means.

8. A chair according to claim 7, wherein said longitudinal movement is a gliding and/or rocking movement.

9. A chair according to claim 7, said base means including laterally spaced support members, said seat means including laterally spaced side elements each located adjacent one of said support members, said connecting means connecting said side elements from said support members and permitting said longitudinal movement of said side elements with respect to said members, said locking means being associated with at least one of said side elements and its adjacent support member and being actuatable to a locked position in response to the raising of said seat means to prevent said longitudinal movement when said seat means is in a raised position and actuatable to an unlocked position in response to the lowering of said seat means to permit said longitudinal movement when the seat means is in a lowered seating position.

10. A chair according to claim 9, wherein said longitudinal movement is a gliding and/or rocking movement.

* * * * *